US007297458B2

(12) United States Patent
Belknap et al.

(10) Patent No.: US 7,297,458 B2
(45) Date of Patent: Nov. 20, 2007

(54) IMAGING MEMBERS

(75) Inventors: Nancy L. Belknap, Rochester, NY (US); Andronique Ioannidis, Webster, NY (US); Cindy C. Chen, Rochester, NY (US); Lanhui Zhang, Webster, NY (US); James M. Duff, Mississauga (CA); John F. Graham, Oakville (CA); Timothy P. Bender, Port Credit (CA)

(73) Assignee: Xerox Corporation, Stamford, CT (US)

( * ) Notice: Subject to any disclaimer, the term of this patent is extended or adjusted under 35 U.S.C. 154(b) by 330 days.

(21) Appl. No.: 10/879,426

(22) Filed: Jun. 29, 2004

(65) Prior Publication Data

US 2005/0287454 A1 Dec. 29, 2005

(51) Int. Cl.
*G03G 15/02* (2006.01)

(52) U.S. Cl. ..... 430/59.1; 430/72; 430/75; 430/78; 430/58.8; 430/59.4

(58) Field of Classification Search ..... 430/59.1, 430/78, 75, 72, 58.8, 59.4
See application file for complete search history.

(56) References Cited

U.S. PATENT DOCUMENTS

| | | | | |
|---|---|---|---|---|
| 4,265,990 | A | 5/1981 | Stolka et al. | |
| 4,410,616 | A | 10/1983 | Griffiths et al. | |
| 4,433,039 | A | 2/1984 | Miyakawa et al. | |
| 4,474,865 | A | 10/1984 | Ong et al. | |
| 4,555,463 | A | 11/1985 | Hor et al. | 430/59 |
| 4,587,189 | A | 5/1986 | Hor et al. | 430/59 |
| 4,921,769 | A | 5/1990 | Yuh et al. | 430/64 |
| 4,992,349 | A | 2/1991 | Chen et al. | |
| 5,153,085 | A | 10/1992 | Akasaki et al. | |
| 5,336,577 | A | 8/1994 | Spiewak et al. | 430/59 |
| 5,437,950 | A * | 8/1995 | Yu et al. | 430/58.25 |
| 5,449,580 | A | 9/1995 | Nakamori et al. | |
| 5,468,583 | A | 11/1995 | Gruenbaum et al. | |
| 5,473,064 | A | 12/1995 | Mayo et al. | 540/141 |
| 5,493,016 | A | 2/1996 | Burt et al. | 540/139 |
| 5,645,965 | A | 7/1997 | Duff et al. | 430/59 |
| 5,688,619 | A | 11/1997 | Hongo et al. | |
| 5,756,245 | A | 5/1998 | Esteghamatian et al. | 430/59 |
| 5,994,012 | A | 11/1999 | Watanabe et al. | |
| 6,063,534 | A | 5/2000 | Hamasaki | |
| 6,156,468 | A | 12/2000 | Wehelie et al. | 430/65 |
| 6,177,219 | B1 | 1/2001 | Yuh et al. | 430/65 |
| 6,255,027 | B1 | 7/2001 | Wehelie et al. | 430/65 |
| 6,485,873 | B1 | 11/2002 | Ohkura et al. | |
| 6,573,016 | B2 | 6/2003 | Kami et al. | |
| 6,586,148 | B1 * | 7/2003 | Graham et al. | 430/58.65 |
| 6,858,363 | B2 | 2/2005 | Belknap et al. | |
| 6,936,387 | B2 | 8/2005 | Yao et al. | |
| 6,946,227 | B2 | 9/2005 | Lin et al. | |
| 2003/0211413 | A1 | 11/2003 | Lin et al. | |
| 2004/0009418 | A1 * | 1/2004 | Main et al. | 430/58.75 |
| 2004/0038140 | A1 | 2/2004 | Duff et al. | |

FOREIGN PATENT DOCUMENTS

| | | |
|---|---|---|
| JP | 07-199486 | 8/1995 |
| JP | 2000019758 A | 1/2000 |
| JP | 2002055472 A | 2/2002 |

OTHER PUBLICATIONS

James M. Duff et al., Imaging Members Having a Single Electrophotographic Photoconductive Insulating Layer, U.S. Appl. No. 09/627,283, filed Jul. 28, 2000.
Nancy L. Belknap et al., Photodoncutive Imaging Members, U.S. Appl. No. 10/408,201, filed Apr. 4, 2003.
U.S. Appl. No. 09/302,524, filed Apr. 30, 1999, Murti et al.
Japanese Patent Office Machine-Assisted Translation of JP 07-199486 (pub. Aug. 4, 1995).
Diamond, A.S., ed., Handbook of Imaging Materials, Marcel Dekker, Inc., NY (1991), pp. 427-436.
Borsenberger, Paul M. et al. Organic Photoreceptors for Imaging Systems. New York: Marcel_Dekker, Inc. (1993) pp. 190-195.
Diamond et al. Handbook of Imaging Materials, 2nd edition. New York: Marcel-Dekker, Inc. (2002) pp. 370-381.

* cited by examiner

*Primary Examiner*—Mark A. Chapman
(74) *Attorney, Agent, or Firm*—Eugene O. Palazzo; Fay Sharpe LLP

(57) ABSTRACT

A photoconductive member containing a supporting substrate, a photogenerating layer, and a charge transport layer and wherein the photogenerating layer comprises a photogenerating component, and an electron transport component.

28 Claims, No Drawings

IMAGING MEMBERS

CROSS-REFERENCE TO RELATED APPLICATIONS AND PATENTS

Illustrated in application U.S. Ser. No. 10/879,679, Publication No. 20050287453, entitled Imaging Members, the disclosure of which is totally incorporated herein by reference, is a photoconductive member comprised of a supporting substrate; a photogenerating layer comprised of a photogenerating component, a hole transport component, an electron transport component, and a polymer binder; and a charge transport layer comprised of a charge transport component, an electron transport component and a polymer binder.

Illustrated in U.S. Pat. No. 6,858,363, the disclosure of which is totally incorporated herein by reference, is, for example, a photoconductive imaging member comprised of a supporting substrate, and thereover a single layer comprised of a mixture of a photogenerator component, a charge transport component, an electron transport component, and a polymer binder, and wherein the photogenerating component is, for example, a metal free phthalocyanine.

Illustrated in application U.S. Ser. No. 10/225,402, filed Aug. 20, 2002, now abandoned, Publication No. 20040038140, on Benzophenone Bisimide Malononitrile Derivatives, the disclosure of which is totally incorporated herein by reference, is, for example, a compound having the Formula I

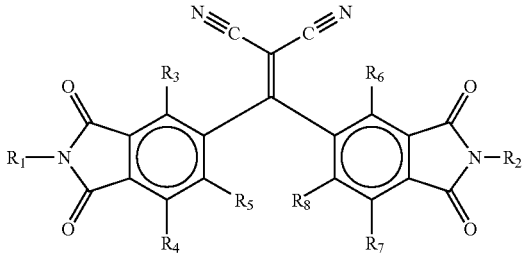

wherein $R_1$ and $R_2$ are independently selected from the group consisting of hydrogen, a heteroatom containing group and a hydrocarbon group that is optionally substituted at least once with a heteroatom moiety; and $R_3$, $R_4$, $R_5$, $R_6$, $R_7$, and $R_8$ are independently selected from the group consisting of a nitrogen containing group, a sulfur containing group, a hydroxyl group, a silicon containing group, hydrogen, a halogen, a heteroatom containing group and a hydrocarbon group that is optionally substituted at least once with a heteroatom moiety.

Illustrated in application U.S. Ser. No. 10/144,147, filed May 10, 2002, now abandoned, Publication No. 20030211413, entitled Imaging Members, the disclosure of which is totally incorporated herein by reference, is, for example, a photoconductive imaging member comprised of a supporting substrate, and thereover a single layer comprised of a mixture of a photogenerator component, a charge transport component, an electron transport component, and a polymer binder, and wherein the photogenerating component can be a metal free phthalocyanine.

Illustrated in application U.S. Ser. No. 09/302,524, filed on Apr. 30, 1999, now abandoned, entitled Photoconductive Members, the disclosure of which is totally incorporated herein by reference, is, for example, an ambipolar photoconductive imaging member comprised of a supporting substrate, and thereover a layer comprised of a photogenerator hydroxygallium component, a charge transport component, and an electron transport component.

Illustrated in application U.S. Ser. No. 09/627,283, filed Jul. 28, 2000, now abandoned, entitled Imaging Members Having a Single Electrophotographic Photoconductive Insulating Layer, the disclosure of which is totally incorporated herein by reference, is, for example, an imaging member comprising a member comprising a supporting layer and a single electrophotographic photoconductive insulating layer, the electrophotographic photoconductive insulating layer comprising particles comprising Type V hydroxygallium phthalocyanine dispersed in a matrix comprising an arylamine hole transporter, and an electron transporter selected from the group consisting of N,N'-bis(1,2-dimethylpropyl)-1,4,5,8-naphthalenetetracarboxylic diimide represented by the following structural formula:

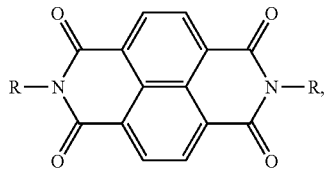

1,1'-dioxo-2-(4-methylphenyl)-6-phenyl-4-(dicyanomethylidene) thiopyran represented by the following structural formula

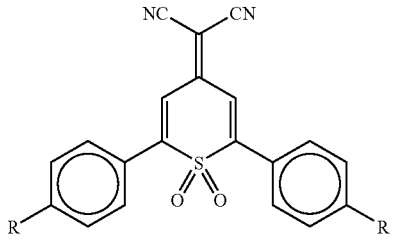

wherein each R is independently selected from the group consisting of hydrogen, alkyl with 1 to 4 carbon atoms, alkoxy with 1 to 4 carbon atoms and halogen, and a quinone selected from the group consisting of carboxybenzylhaphthaquinone represented by the following structural formula

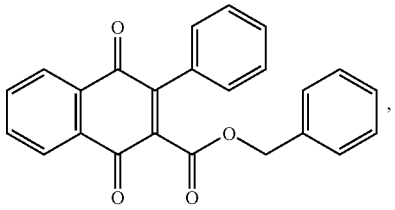

tetra (t-butyl) diphenoquinone represented by the following structural formula

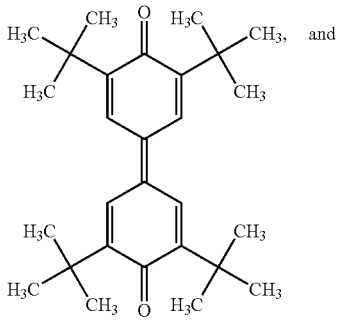

mixtures thereof, and a film forming binder.

Illustrated in U.S. Pat. No. 6,444,386, the disclosure of which is totally incorporated herein by reference, is a photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

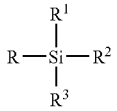

(II)

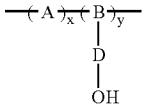

wherein R is alkyl or aryl, $R^1$, $R^2$, and $R^3$ are independently selected from the group consisting of alkoxy, aryloxy, acyloxy, halide, cyano, and amino; A and B are respectively divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

There is illustrated in U.S.Pat. No. 6,913,863, filed Feb. 19, 2003, entitled Photoconductive Imaging Members, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in U.S. Pat. No. 6,875,548, entitled Photoconductive Imaging Members, filed Feb. 19, 2003, the disclosure of which is totally incorporated herein by reference, a photoconductive imaging member comprised of an optional supporting substrate, a photogenerating layer, and a charge transport layer, and wherein said charge transport layer is comprised of a charge transport component and a polysiloxane.

There is illustrated in U.S. Pat. No. 6,824,940, entitled Photoconductive Imaging Members, filed Feb. 19, 2003, the disclosure of which is totally incorporated herein by reference, a photoconductive imaging member containing a hole blocking layer, a photogenerating layer, a charge transport layer, and thereover an overcoat layer comprised of a polymer with a low dielectric constant and charge transport molecules.

There is also illustrated in U.S. Pat. No. 7,115,345, entitled Electrophotographic Imaging Members, filed Feb. 17, 2004, the disclosure of which is totally incorporated herein by reference, a photoreceptor comprising a top durable layer that is charge generating and/or charge transporting; and a bottom layer that is bipolar charge transporting or bipolar charge generating, wherein the photoreceptor has a negative charging mode of operation.

The appropriate components and processes of the above copending applications, such as the photogenerating pigments, substrates, charge transport and electron transports, overcoating layers, blocking layers, adhesive layers, may be selected for the invention of the present application in embodiments thereof.

BACKGROUND

Illustrated herein are imaging members, and more specifically, positively and negatively charged electrophotographic imaging members and processes for forming images on the member. More specifically, disclosed herein are layered photoconductive imaging members useful in electrostatic digital, including color, process, and which members contain an optional supporting substrate, a photogenerating layer, a charge transport layer, and an optional protective overcoating layer and wherein the photogenerating layer contains a mixture of a photogenerating pigment, or pigments, an optional polymeric binder, and an electron transport component. In embodiments, the amount of photogenerating pigment and the amount of electron transport selected can each be adjusted to, for example, permit the photosensitivity tuneability of the photogenerating layer. More specifically, in embodiments the amount or concentration of the higher sensitivity photogenerating pigment present in the photogenerating layer can be preselected and varied to, for example, permit a number of different photosensitivities for the imaging members thereof.

Advantages of the imaging members illustrated herein in embodiments include the avoidance of extended milling times of a second photogenerating pigment in the photogenerating layer to thereby avoid/minimize an increase in the dark decay characteristics and maintaining the capacitive charging characteristics at low fields, and wherein the electrical properties of the members are excellent and in some instances improved as compared to similar members without an electron transport in the photogenerating and without adjusting the amount of a photogenerating pigment as illustrated herein. Also, when a blocking layer is present, especially a thick layer of, for example, from about 1 to about 20 microns, there can be achieved a reduction in the residual voltage caused primarily by the diffusion/penetration of the electron transport component from the photogenerating layer into the blocking layer thereby improving the electron mobility of the blocking layer. Moreover, in embodiments when the photogenerating layer contains the electron transport component there is permitted, for example, thicker photogenerating layers while maintaining relatively high pigment concentrations such that much of the light absorption is accomplished at the top, from about 2 to about 5 microns, and which layer may also minimize charge deficient spots and may allow improvements in the preparation of the members and the coating robustness thereof. Also, the presence of an electron transport component in the photogenerating layer can enhance electron mobility and thus enable a thicker photogenerating layer, and which thick layers can be more easily coated than a thin layer, such as about 0.1 to about 2 microns thick.

The imaging members of the present invention in embodiments exhibit excellent cyclic/environmental stability; excellent wear characteristics; extended lifetimes of, for example, up to 1,000,000 imaging cycles; minimum microcracking; elimination/minimization of adverse affects when contacted with a number of solvents such as methylene chloride, tetrahydrofuran and toluene; acceptable and in some instances improved electrical characteristics; excellent imaging member surface properties; and which members can be selected for both drum and belt photoreceptors.

Processes of imaging, especially xerographic imaging, and printing, including digital, are also encompassed by the present invention. More specifically, the photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 475 to about 950 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Disclosed in U.S. Pat. No. 5,645,965, the disclosure of which is totally incorporated herein by reference, are photoconductive imaging members comprised of a symmetrical dimeric perylene as a charge generator, wherein said perylene is of the formulas illustrated in this patent. The perylene charge transport molecules and other appropriate components of this patent may be selected for the imaging members of the present invention in embodiments thereof.

Illustrated in U.S. Pat. No. 5,756,245, the disclosure of which is totally incorporated herein by reference, is a photoconductive imaging member comprised of a hydroxygallium phthalocyanine photogenerator layer, a charge transport layer, a barrier layer, a photogenerator layer comprised of a mixture of bisbenzimidazo(2,1-a-1',2'-b)anthra(2,1,9-def:6,5,10-d'e'f')diisoquinoline-6,11-dione and bisbenzimidazo (2,1-a:2',1'-a)anthra(2,1,9-def:6,5,10-d'e'f') diisoquinoline-10,21-dione, and thereover a charge transport layer.

Illustrated in U.S. Pat. No. 5,493,016, the disclosure of which is totally incorporated herein by reference, is a process for the preparation of alkoxy-bridged metallophthalocyanine dimers by the reaction of a gallium alkoxide with ortho-phthalodinitrile or 1,3-diiminoisoindoline in the presence of a diol.

Also, in U.S. Pat. No. 5,473,064, the disclosure of which is totally incorporated herein by reference, there is illustrated a process for the preparation of hydroxygallium phthalocyanine consisting essentially of the hydrolysis of halogallium phthalocyanine precursor to a hydrogallium phthalocyanine, and conversion of said resulting hydroxygallium phthalocyanine to Type V hydroxygallium phthalocyanine by contacting said resulting hydroxygallium phthalocyanine with the organic solvent N,N-dimethylformamide, pyridine, dimethylsulfoxide, quinoline, 1-chloronaphthalene, N-methylpyrrolidone, or mixtures thereof, and wherein said hydroxygallium phthalocyanine Type V contains halide in an amount of from about 0.001 percent to about 0.1 percent; and wherein said precursor halogallium phthalocyanine is obtained by the reaction of gallium halide with diiminoisoindoline in an organic solvent.

U.S. Pat. No. 4,265,990, the disclosure of which is totally incorporated herein by reference, illustrates a photosensitive member having at least two electrically operative layers. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula. This member may be imaged in the conventional xerographic mode which usually includes charging, exposure to light and development.

U.S. Pat. No. 5,336,577, the disclosure of which is totally incorporated herein by reference, illustrates a thick organic ambipolar layer on a photoresponsive device, and which device is simultaneously capable of charge generation and charge transport. In particular, the organic photoresponsive layer contains an electron transport material, such as a fluorenylidene malononitrile derivative, and a hole transport material, such as a dihydroxy tetraphenyl benzadine containing polymer.

The uses of a number of pigments in the photogenerating layer perylene pigments as photoconductive substances is known. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

A number of photoconductive members and components thereof are illustrated in U.S. Pat. Nos. 4,988,597; 5,063,128; 5,063,125; 5,244,762; 5,612,157; 6,218,062; 6,200,716 and 6,261,729, the disclosures of which are totally incorporated herein by reference.

SUMMARY

A feature of the present disclosure is to provide electrophotographic imaging members with many of the advantages illustrated herein.

It is another feature of the present disclosure to provide photoconductive imaging members with high concentrations of photogenerating pigment or pigments, which high concentrations are, for example, from about 30 to about 60 percent by weight and thereby permit charge generation to occur in the top, about 0.5 micron, surface of the photogenerating layer.

It is still another feature of the present disclosure to provide electrophotographic imaging members of a thickness of, for example, from about 5 to about 60 microns, or from about 15 to about 50 microns, and which members possess excellent high photosensitivities, acceptable discharge characteristics, improved dark decay, that is, for example, a decrease in the dark decay as compared to a number of similar prior art members, and further which members are visible and infrared laser compatible.

It is yet another feature of the present disclosure to provide an electrophotographic imaging member comprising a photogenerating layer containing a charge transport, and more specifically, an electron transport compound, especially those compounds that are soluble in the solvent matrix selected for the coating of the photogenerating layer and to provide a member wherein the integrity of the photogenerating pigment dispersion is excellent without inducing precipitation, agglomeration or structure formation, and which electron transport compound can provide for additional pathways for electron transport thereby enabling members with a suitable thickness.

It is another feature of the present disclosure to provide photoconductive members which eliminate/minimize charge spreading, and possess reduced dark decay characteristics, therefore, enabling higher resolution, and which members are not substantially susceptible to plywooding effects, light refraction problems.

Additionally, in another feature of the present disclosure there are provided imaging members wherein the photogenerating layer contains electron transport molecules of NTDI, N,N'-bis(1,2-dimethylpropyl)-1,4,5,8-naphthalenetetracarboxylic diimide; substituted NTDI wherein the substituent is bis(2-heptylimido)perinone; BCFM, butoxy carbonyl fluorenylidene malononitrile; BIB-CNs (benzophenone bisimide); substituted derivatives of BIB-CNs, and the like.

Another feature of the present disclosure is to provide imaging members with single pigment tunable sensitivity.

In another feature of the present disclosure there is provided a photogenerating layer which can contain two or more pigments, and electron, especially soluble, transporting components, and wherein a substantial amount of light of a suitable wavelength is absorbed on the top part of the thicker charge generating later.

There is disclosed in embodiments thereof a photoconductive member comprised of a supporting substrate, a photogenerating layer, and a charge transport layer and wherein the photogenerating layer comprises a photogenerating component, and an electron transport component, and wherein the electron transport component is selected from the group consisting of a carbonylfluorenone malononitrile of the formula

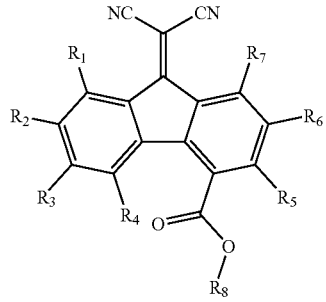

wherein each R is independently selected from the group consisting of hydrogen, alkyl, alkoxy, aryl, and halide; a nitrated fluorenone of the formula

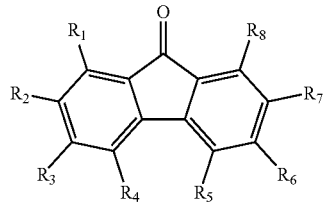

wherein each R is independently selected from the group consisting of alkyl, alkoxy, aryl, and halide, and wherein at least two R groups are nitro; a diimide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

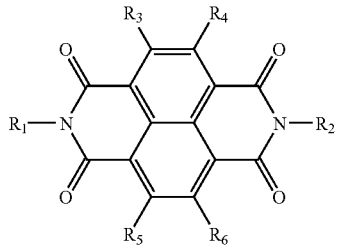

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

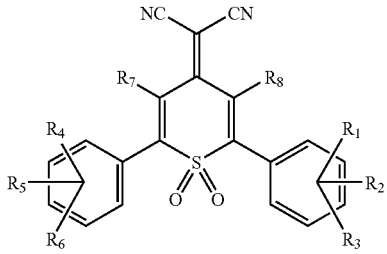

wherein each R is independently selected from the group consisting of hydrogen, alkyl, alkoxy, aryl, and halide; a carboxybenzylnaphthaquinone of the alternative formulas

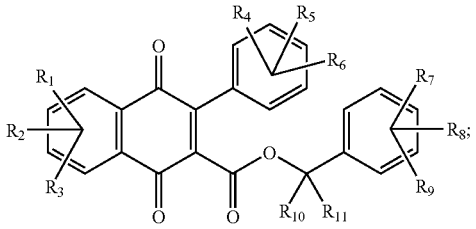

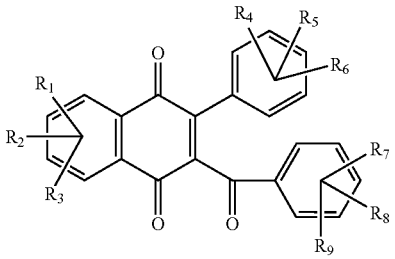

wherein each R is independently selected from the group consisting of hydrogen, alkyl, alkoxy, aryl, and halide; and a diphenoquinone of the formula

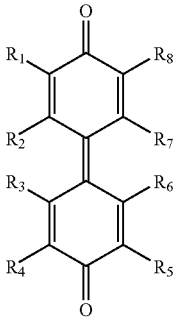

wherein each R is independently selected from the group consisting of hydrogen, alkyl, alkoxy, aryl, and halide, and optionally wherein each R substituent may be a suitable group not specifically or generally disclosed; a photoconductive imaging member wherein the supporting substrate is comprised of a conductive metal substrate; a photoconductive imaging member wherein the conductive substrate is aluminum, aluminized polyethylene terephthalate or a titanized polyethylene; a photoconductive imaging member wherein the photogenerator layer is of a thickness of from about 100 nanometers to about 5 microns; a photoconductive imaging member wherein the charge, such as hole transport layer, is of a thickness of from about 20 to about 75 microns; a photoconductive imaging member wherein the photogenerating layer is comprised of photogenerating pigments dispersed in an optional resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals and an electron transporting material in an amount of from about 5 percent by weight to about 40 percent by weight; a photoconductive imaging member wherein the charge transport layer comprises aryl amine molecules; a photoconductive imaging wherein the charge transport aryl amines are, for example, of the formula

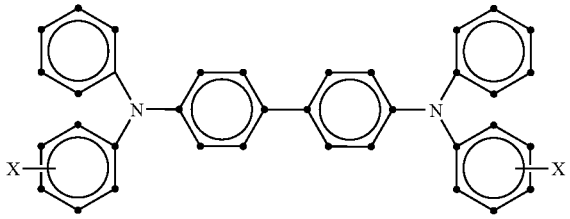

wherein X is selected from the group consisting of alkyl, alkoxy, and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member where in the photogenerating layer is comprised of titanyl phthalocyanines, perylenes, alkylhydroxygallium phthalocyanines, hydroxygallium phthalocyanines, or mixtures thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; an imaging member wherein the hole blocking layer is a phenolic compound of bisphenol S, 4,4'-sulfonyidiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl)methane; an imaging member wherein the phenolic compound is bisphenol M, 4,4'-(1,3-phenylenediisopropylidene) bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene) diphenol; an imaging member wherein the phenolic compound is resorcinol, 1,3-benzenediol; an imaging member comprised in the sequence of a supporting substrate, a hole blocking layer, an optional adhesive layer, a photogenerating layer, a hole transport layer and an overcoating layer as illustrated herein; an imaging member wherein the adhesive layer is comprised of a polyester with an $M_w$ of about 40,000 to about 75,000, and an $M_n$ of from about 30,000 to about 45,000; an imaging member wherein the photogenerator layer is of a thickness of from about 100 nanometers to about 5 microns, and wherein the transport layer is of a thickness of from about 20 to about 65 microns; an imaging member wherein the photogenerating layer is comprised of photogenerating pigments dispersed in a resinous binder in an amount of from about 10 percent by weight to about 90 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises suitable known or future developed components; an imaging member wherein the photogenerating layer is comprised of a mixture of metal phthalocyanines and metal free phthalocyanines; an imaging member wherein the photogenerating layer is comprised of effective amounts of titanyl phthalocyanines, perylenes, hydroxygallium phthalocyanines, other known photogenerating pigments, mixtures thereof, especially a mixture of two pigments, and wherein the concentration of the higher photosensitivity pigment amount is, for example, from about 40 percent by weight to about 95 percent by weight, and wherein the amount of the first pigment is from about 5 percent by weight to about 60 percent by weight, the electron transport amount is from about 2 to about 60, and more specifically, from 5 about to about 40, and the polymeric binder amount is, for example, from about—10 to about 90, and more specifically, from about 30 to about 70 percent by weight; an imaging member wherein the photogenerating layer is comprised of Type V hydroxygallium phthalocyanine; a method of imaging which comprises generating an electrostatic latent image on the imaging member illustrated herein, developing the latent image with a known toner, and transferring the developed electrostatic image to a suitable substrate like paper; a photoconductive imaging member comprised in sequence of a substrate, a single electrophotographic photoconductive insulating layer, the electrophotographic photoconductive insulating layer comprising photogenerating particles comprising photogenerating pigments, such as metal free phthalocyanines, hydroxy gallium phthalocyanines, chlorogallium phthalocyanines, titanyl phthalocyanines, perylenes, mixtures thereof, and the like, and an electron transport material, for example, selected from the group consisting of N,N'-bis(2,2-dimethylpropyl)-1,4,5,8-naphthalenetetracarboxylic diimide, (NTDI), substituted NTDI, butoxy carbonyl fluorenylidene malononitrile, 2-EHCFM, a higher solubility BCFM, a fluorenylidene, such as (4-n-butoxycarbonyl-9-fluorenylidene)malononitrile, reference U.S. Pat. No. 4,474,865, the disclosure of which is totally incorporated herein by reference, the electron transports illustrated herein and in the appropriate copending applications recited herein; mixtures thereof, and the like; a photoconductive imaging member containing in the photogenerating layer an electron transport component, and a polymer binder, and wherein the electron transport component is selected from the group consisting of a carbonylfluorenone malononitrile of the formula

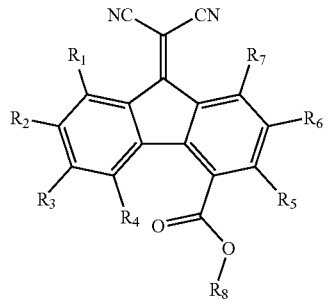

wherein each R is independently selected from the group consisting of hydrogen, alkyl, alkoxy, aryl, and halide; a nitrated fluorenone of the formula

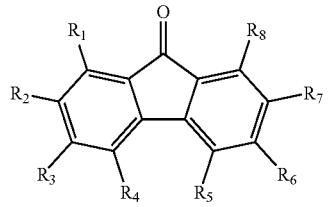

wherein each R is independently selected from the group consisting of alkyl, alkoxy, aryl, and halide, and wherein at least two R groups are nitro; a diimide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

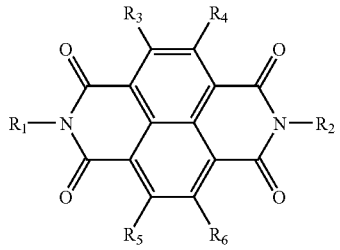

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

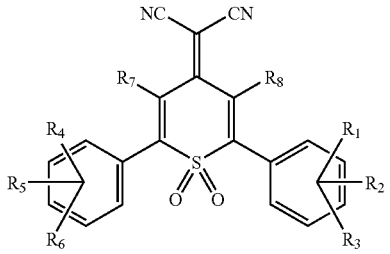

wherein each R is independently selected from the group consisting of hydrogen, alkyl, alkoxy, aryl, and halide; a carboxybenzylnaphthaquinone of the alternative formulas

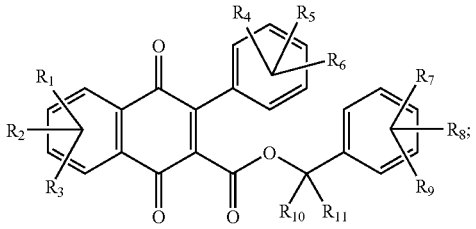

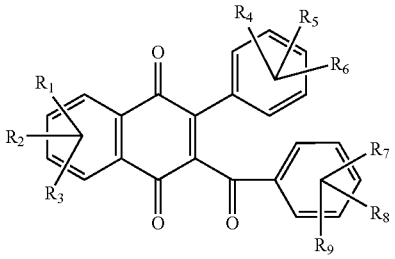

wherein each R is independently selected from the group consisting of hydrogen, alkyl, alkoxy, aryl, and halide; and a diphenoquinone of the formula

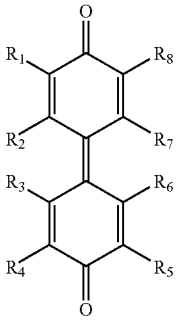

wherein each R is independently selected from the group consisting of hydrogen, alkyl, alkoxy, aryl, and halide; a photoconductive member of a thickness of from about 15 to about 60 microns, and wherein there is enabled high photosensitivity, efficient charge generation, acceptable insulating properties while the member is in a dark environment with no light, or little light, substantially high leakage resistance, excellent dark decay characteristics, and more specifically, low dark decay as illustrated herein; a member wherein the amounts for each of the components in the photogenerating layer mixture is from about 20 weight percent to about 60 weight percent for the photogenerating component, from about 30 to about 70 percent by weight for the polymeric binder, and from about 5 weight percent to about 40 weight percent of the electron transport component, and wherein the total of the components is about 100 percent; a member wherein there is selected as the photogenerating pigment a metal free phthalocyanine that absorbs light of a wavelength of from about 550 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the binder for the photogenerating mixture layer is selected from the group consisting of polyesters, polyvinyl butyrals, polycarbonates, polystyrene-b-polyvinyl pyridine, polyvinyl formulas; PCZ polycarbonates; and the like; an imaging member wherein the charge transport comprises aryl amine molecules; an imaging member wherein the electron transport component is BCFM, (4-n-butoxycarbonyl-9-fluorenylidene)malononitrile, 2-methylthioethyl 9-dicyano methylenefluorene-4-carboxylate, 2-(3-thienyl)ethyl 9-dicyanomethylene fluorene-4-carboxylate, 2-phenylthioethyl 9-dicyanomethylenefluorene-4-carboxylate, or 11,11,12,12-tetracyano anthraquinodimethane; an imaging member wherein the electron transport is NTDI, BCFM, and the charge transport is a hole transport of N,N'-diphenyl-N,N-bis(3-methyl phenyl)-1,1'-biphenyl-4,4'-diamine molecules; an imaging member wherein the X polymorph metal free phthalocyanine selected as a photogenerating pigment has major peaks, as measured with an X-ray diffractometer, at Bragg angles (2 theta+/−0.2°); an imaging member wherein the photogenerating component mixture layer further contains a second photogenerating pigment; an imaging member wherein the photogenerating mixture layer contains a perylene; an imaging member wherein the photogenerating component is comprised of a mixture of a metal free phthalocyanine, and a second photogenerating pigment; a method of imaging which comprises generating an electrostatic latent image on the imaging member, developing the latent image, and transferring the developed electrostatic image to a suitable substrate; a method of imaging wherein the imaging member is exposed to light of a wavelength of from about 500 to about 950 nanometers; an imaging apparatus containing a charging component, a development component, a transfer component, and a fixing component, and wherein the apparatus contains a photoconductive imaging member as illustrated herein; an imaging member wherein the blocking layer is contained as a coating on a substrate, and wherein the adhesive layer is coated on the blocking layer; and photoconductive imaging members comprised of a mixture of an electron transport component, a polymeric binder, and a photogenerating pigment of a phthalocyanine, a BZP perylene, which BZP is preferably comprised of a mixture of bisbenzimidazo(2,1-a-1',2'-b)anthra(2,1,9-def:6,5,10-d'e'f') diisoquinoline-6,11-dione and bisbenzimidazo(2,1-a:2',1'-a) anthra(2,1,9-def:6,5,10-d'e'f')diisoquinoline-10,21-dione, reference U.S. Pat. No. 4,587,189, the disclosure of which is totally incorporated herein by reference; photoconductive imaging member comprised of a photogenerating pigment or pigments, an electron transport, and a polymeric binder; and wherein the pigment or pigments are comprised of x metal free phthalocyanine; trivalent metal phthalocyanines, such as chlorogallium phthalocyanine (CIGaPc); metal phthalocyanines, such as hydroxygallium phthalocyanine (OHGaPc); titanyl phthalocyanine (OTiPC); benzylimidizo perylene (BZP); 535+dimer, and wherein the charge transport is comprised of hole transporting molecules of Ae-18; AB-16; N,N'-diphenyl-N,N'-bis-(alkylphenyl)-1,1-biphenyl-4,4' diamine, mixtures thereof, and which mixtures can contain, for example, from about 1 to about 99 percent of one hole transport, and from about 99 to about 1 weight percent of a second hole transport, and wherein the total thereof is about 100 percent; from about 40 to about 65 percent of one hole transport, and from about 65 to about 40 weight percent of a second hole transport, and wherein the total thereof is about 100 percent; from about 30 to about 65 percent of one hole transport, from about 30 to about 65 weight percent of a second hole transport, and from about 30 to about 65 weight percent of a third hole transport and wherein the total thereof is about 100 percent.

Any suitable effective substrate may be selected for the imaging members. The substrate may be opaque or substantially transparent, and may comprise any suitable material with the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium and the like, or exclusively be comprised of a conductive material such as aluminum, chromium, nickel, brass and the like. The substrate may be flexible, seamless or rigid and may have a number of many different configurations, such as, for example, a plate, a drum, a scroll, an endless flexible belt, and the like. In embodiments, the substrate is in the form of a seamless flexible belt. The back of the substrate, particularly when the substrate is a flexible organic polymeric material, may optionally be coated with a conventional anticurl layer. Examples of substrate layers selected for the imaging members of the present invention can be as indicated herein, such as an opaque or substantially transparent material, and may comprise any suitable material with the requisite mechanical properties. Thus, the substrate may comprise a layer of insulating material including inorganic or organic polymeric materials, such as MYLAR® a commercially available polymer, MYLAR® containing titanium, or other suitable metal, a layer of an organic or inorganic material having a semiconductive surface layer, such as indium tin oxide, or aluminum arranged thereon, or a conductive material inclusive of aluminum, chromium, nickel, brass or the like. The thickness of the substrate layer as indicated herein depends on many factors, including economical considerations, thus this layer may be of substantial thickness, for example over 300 microns, such as from about 300 to about 700 microns, or of a minimum thickness. In embodiments, the thickness of this layer is from about 75 microns to about 300 microns. The thickness of the member can be, for example, from about 5 microns to about 70 microns, and more specifically, from about 15 microns to about 45 microns.

The binder resin present in various suitable amounts, for example from about 5 to about 70, more specifically, from about 10 to about 70 weight percent, and yet more specifically, from about 30 to about 50 weight percent in the photogenerating layer or the charge transport layer, may be selected from a number of known polymers such as poly (vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like, and more specifically, bisphenol-Z-carbonate (PCZ), PCZ-200 with a weight average molecular weight of about 20,000, PCZ-500 with a weight average molecular weight of about 51,000, PCZ-400 with a weight average molecular weight of about 40,000, PCZ-800 with a weight average molecular weight of about 80,000, and mixtures thereof. In embodiments, it may be desirable to select as coating solvents, ketones, alcohols, aromatic hydrocarbons, halogenated aliphatic hydrocarbons, ethers, amines, amides, esters, and the like; more specifically, there may be selected as solvents cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like; and yet more specifically, tetrahydrofuran, (THF), monochlorobenzene, cyclohexanone, methylene chloride, and mixtures thereof.

An optional adhesive layer may be formed on the substrate. Typical materials employed as an undercoat adhesive layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometer to about 10 micrometers. A thickness of from about 0.1 micrometer to about 3 micrometers can be desirable. Optionally, the undercoat layer may contain suitable amounts of additives, for example, of from about 1 weight percent to about 10 weight percent of conductive or nonconductive particles, such as zinc oxide, titanium dioxide, silicon nitride, carbon black, and the like, to enhance, for example, electrical and optical properties. The undercoat layer can be coated on to a supporting substrate from a suitable solvent. Typical solvents include, for example, tetrahydrofuran, dichloromethane, and the like, and mixtures thereof.

Examples of photogenerating components, especially pigments, are metal free phthalocyanines, metal phthalocyanines, perylenes, vanadyl phthalocyanine, chloroindium phthalocyanine, and benzimidazole perylene, which is preferably a mixture of, for example, about 60/40, 50/50, 40/60, bisbenzimidazo(2,1-a-1',2'-b)anthra(2,1,9-def:6,5,10-d'e'f') diisoquinoline-6,11-dione and bisbenzimidazo(2,1-a:2',1'-a) anthra(2,1,9-def:6,5,10-d'e'f') diisoquinoline-10,21-dione, chlorogallium phthalocyanines, hydroxygallium phthalocyanines, titanyl phthalocyanines, and the like, inclusive of appropriate known photogenerating components, reference for example the copending applications recited herein.

Charge transport components that may be selected are as illustrated herein, and in the copending applications recited herein, such as, for example, arylamines, and more specifically, N,N'-diphenyl-N,N-bis(3-methyl phenyl)-1,1'-biphenyl-4,4'-diamine, 9-9-bis(2-cyanoethyl)-2,7-bis(phenyl-m-tolylamino)fluorene, tritolylamine, hydrazone, N,N'-bis(3,4 dimethylphenyl)-N"(1-biphenyl) amine, and the like.

Specific examples of electron transport molecules are as illustrated herein like (4-n-butoxycarbonyl-9-fluorenylidene)malononitrile, 2-methylthioethyl 9-dicyano methylenefluorene-4-carboxylate, 2-(3-thienyl)ethyl 9-dicyano methylenefluorene-4-carboxylate, 2-phenylthioethyl 9-dicyano methylenefluorene-4-carboxylate, 11,11,12,12-tetracyano anthraquino dimethane, 1,3-dimethyl-10-(dicyanomethylene)-anthrone, and the like.

The photogenerating pigment can be present in various amounts, such as, for example, from about 10 weight percent to about 70 weight percent, and more specifically, from about 20 weight percent to about 60 weight percent; the electron transport can be present in various amounts, such as in an amount of from about 2 weight percent to about 75 weight percent, and more specifically, in an amount of from about 5 weight percent to about 50 weight percent; and the polymer binder can be present in an amount of from about 10 weight percent to about 90 weight percent, and more specifically, in an amount of from about 30 weight percent to about 70 weight percent.

Charge transport layer polymer binder examples include components as illustrated herein, reference, for example, U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000, and more specifically, with a molecular weight, $M_w$ of from about 50,000 to about 100,000 and the polymer binders, such as PCZ as illustrated herein.

The imaging members illustrated herein are useful in various electrostatographic imaging and printing systems, particularly those conventionally known as xerographic processes. Specifically, the imaging members are useful in xerographic imaging processes wherein the photogenerating component absorbs light of a wavelength of from about 550 to about 950 nanometers, and more specifically, from about 700 to about 850 nanometers. Moreover, the imaging members of the present invention can be selected for electronic printing processes with gallium arsenide diode lasers, light emitting diode (LED) arrays, which typically function at wavelengths of from about 660 to about 830 nanometers, and for color systems inclusive of color printers, such as those in communication with a computer. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example by heat, the image thereto. In those environments wherein the member is to be used in a printing mode, the imaging method is similar with the exception that the exposure step can be accomplished with a laser device or image bar.

The following Examples are provided.

The XRPDs were determined as indicated herein, that is X-ray powder diffraction traces (XRPDs) were generated on a Philips X-Ray Powder Diffractometer Model 1710 using X-radiation of CuK-alpha wavelength (0.1542 nanometer).

The photoconductive imaging members can be prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating, electron transport, and charge transport components of the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow.

Other component layers may be included in the photoconductive member including know components and layers, overcoating protective layers, and the like.

EXAMPLE I

Photoreceptor Device:

A multi-layer photoreceptor device was prepared on an aluminum drum, cleaned with detergent and rinsed with deionized water, dip coated using a pull rate of 160 millimeters/minute and with an undercoat layer deposited on the aluminum substrate comprised of a deposited titanium oxide/phenolic resin dispersion comprised of 54 weight percent titanium dioxide (STR60N™, Sakai Company), 6 weight percent $SiO_2$ (P100, Esprit) and 40 weight percent phenolic resin (VARCUM™ 29159, OxyChem Company, $M_w$ about 3,600, viscosity about 200 cps) in a 1:1 weight mixture of 1-butanol and xylene, and subsequently dried at 160° C. for 15 minutes. The resulting undercoat layer (UCL) had a dry thickness of 4 microns.

The charge generator coating solution was subsequently applied to the above generated undercoat layer using a Tsukiage ring coating method. The thickness of the layer was kept constant by preparing the charge generator coating solutions at the same viscosity, and utilizing the same pullrate of 80 millimeters/minute to form charge generation layers of about 1 to about 1.5 micrometer in thickness:

Comparative Example 1: Type V hydroxygallium phthalocyanine pigment, poly(4,4'-diphenyl-1,1'-cyclohexane carbonate), in a solids weight ratio of (40:60)

Example I: Type V hydroxygallium phthalocyanine pigment, electron transporter of 4-n-butoxycarbonyl-9-fluorenylidenemalononitrile, and the binder poly(4,4'-diphenyl-1,1'-cyclohexane carbonate) in a solids weight ratio of (30:10:60).

Example II: Type V hydroxygallium phthalocyanine pigment, electron transporter of 4-n-butoxycarbonyl-9-fluorenylidenemalononitrile, and the binder poly(4,4'-diphenyl-1,1'-cyclohexane carbonate) in a solids weight ratio of (20:20:60).

A photogenerating layer dispersion was prepared by roll milling 3 grams of Type V hydroxygallium phthalocyanine pigment particles and 12 grams of poly(4,4'-diphenyl-1,1'-cyclohexane carbonate) binder (PCZ200) in 115 grams of tetrahydrofuran (THF) with several hundred, about 700 to 800 grams, of 3 millimeter diameter steel or yttrium zirconium balls for about 2 to about 72 hours.

Comparative Device 1: Separately, 0.5 gram of poly(4,4'-diphenyl-1,1'-cyclohexane carbonate), (PCZ500 available from Teijin Chemical, Ltd.) was weighed along with 15.45 grams of THF solvent. This mixture was rolled in a glass bottle until the solids were dissolved, then 4.05 grams of the above pigment dispersion were added to form the charge generator coating solution and rolled to mix (without milling beads). The resulting dispersion was applied directly over the undercoat layer by dip coating with a pull rate of 200 millimeters/minute to form the charge generation layer comprised of Type V hydroxygallium phthalocyanine pigment, poly(4,4'-diphenyl-1,1'-cyclohexane carbonate), in a solids weight ratio of (40:60) and a total solid content of 5 weight percent in THF solvent. The device was dried in a forced air oven for 5 minutes at 120° C., and the resulting dried layer had a thickness of 1.5 micrometers.

Comparative Device 2: Separately, 0.58 gram of poly(4,4'-diphenyl-1,1'-cyclohexane carbonate), (PCZ500 available from Teijin Chemical, Ltd.) were weighed along with 16.17 grams of THF solvent. This mixture was rolled in a glass bottle until the solids were dissolved, then 3.12 grams of the above pigment dispersion were added to form the charge generator coating solution and which solution was rolled to mix (without milling beads). The resulting dispersion was applied directly over the undercoat layer by dip coating with a pull rate of 200 millimeters/minute to form the charge generation layer comprised of Type V hydroxygallium phthalocyanine pigment, poly(4,4'-diphenyl-1,1'-cyclohexane carbonate), in a solids weight ratio of (36:64) and a total solid content of 5 weight percent in THF solvent. The device was dried in a forced air oven for 5 minutes at 120° C., and the resulting dried layer had a thickness of 1.5 micrometers.

Devices: Charge generator coating solutions with enhanced electron transport components were similarly prepared and applied to undercoat layers as in Comparative Device 1.

Device 1: Separately, a charge generator coating solution was prepared where 0.10 gram of 4-n-butoxycarbonyl-9-fluorenylidenemalononitrile and 0.53 gram of PCZ500 were weighed along with 16.34 grams of THF solvent in a glass bottle and rolled until the solids were dissolved. Then, 3.03 grams of the pigment dispersion were added to form the charge generator coating solution containing the Type V hydroxygallium phthalocyanine pigment, electron transporter of 4-n-butoxycarbonyl-9-fluorenylidenemalononitrile, and the binder poly(4,4'-diphenyl-1,1'-cyclohexane carbonate), in a solids weight ratio of (30:10:60) and a total solid content of 5 weight percent in THF solvent; and then rolled to mix (without milling beads).

Device 2: Separately, a charge generator coating solution was prepared where 0.20 gram of 4-n-butoxycarbonyl-9-fluorenylidenemalononitrile and 0.55 gram of PCZ500 were weighed along with 17.23 grams of THF solvent in a glass bottle and rolled until the solids were dissolved. Then, 2.02 grams of the above pigment dispersion were added to form the charge generator coating solution containing the Type V hydroxygallium phthalocyanine pigment, electron transporter or electron transport of 4-n-butoxycarbonyl-9-fluorenylidenemalononitrile, and the binder poly(4,4'-diphenyl-1,1'-cyclohexane carbonate) in a solids weight ratio of (20:20:60) and a total solid content of 5 weight percent in THF solvent; and rolled to mix (without milling beads).

Finally, all the devices were overcoated with a charge transport coating solution utilizing a dip coating process with a solution comprised of 31 weight percent (N,N'-bis-(3,4-dimethylphenyl)-4,4'-biphenyl amine)/16 weight percent (N,N'-diphenyl-N,N-bis(3-methylphenyl)-1,1'-biphenyl-4,4'-diamine) and 51 weight percent PCZ300 in MCB: THF solvent system at 25:75 weight ratios with a final concentration of 20 weight percent solid. A pull rate of 180 millimeters/minute yields a charge transport layer thickness of 27 micrometers.

EXAMPLE II

The devices of Example I were electrically tested with a cyclic scanner set to obtain 100 charge-erase cycles immediately followed by an additional 100 cycles, sequences at 2 charge-erase cycles and 1 charge-expose-erase cycle, wherein the light intensity was incrementally increased with cycling to produce a photoinduced discharge curve from which the photosensitivity was measured. The scanner was equipped with a single wire corotron (5 centimeters wide) set to deposit 100 nanocoulombs/cm$^2$ of charge on the surface of the drum devices. The devices of Example I were tested in the negative charging mode. The exposure light intensity was incrementally increased by means of regulating a series of neutral density filters, and the exposure wavelength was controlled by a band filter at 780±5 nanometers. The exposure light source was 1,000 watt Xenon arc lamp white light source. The dark discharge of the photoreceptor was measured by monitoring the surface potential for 7 seconds after a single charge cycle of 100 nanocoulombs/cm$^2$ (without erase). Photosensitivity (dV/dx) was calculated from the initial discharge rate at low exposure intensity, determined at about 70 percent of the initial voltage (about 0 to about 0.7 erg/cm$^2$ exposure).

The drum was rotated at a speed of 40 rpm to produce a surface speed of 62.8 millimeters/second or a cycle time of 1.5 seconds. The xerographic simulation was carried out in an environmentally controlled light tight chamber at ambient conditions (30 percent RH and 22° C.).

| Sample | Photosensitivity (V cm$^2$/erg) | Residual (V) | Dark Discharge (V/s) |
|---|---|---|---|
| Comparative Device 1 | 390 | 37 | 20.97 |
| Device 1 | 372 | 31 | 15.75 |
| Device 2 | 301 | 33 | 14.14 |
| Comparative Device 2 | 372 | 109 | 17 |

Devices 1 and 2 of Example I demonstrate the selective tuning of photosensitivity where, for example, as the loading of pigment decreases the sensitivity of the photoreceptor decreases, but the residual voltage does not concomitantly increase since the necessary mobility was maintained by the introduction of the electron transport (ETM). As the concentration of pigment was decreased from 40 percent to 20 percent, it was replaced by ETM to facilitate the transport of electrons in the charge generating layer (CGL). The diffusion of the charge transporting small molecules from the CTL into the CGL as a result of the coating process enabled efficient charge injection into the charge, especially hole, transport layer (CTL). The concomitant decrease in the dark discharge voltage was commensurate with the decreased pigment loading. A comparison of Device 1 with Comparative Device 2 (prepared with a slightly higher pigment loading in the same binder system) demonstrated the transport advantage obtained from the addition of the electron transporting material, which resulted in lowering the residual voltage while the photosensitivity remained constant.

EXAMPLE III

WEB Example:

An imaging member was prepared by providing a 0.02 micrometer thick titanium layer coated on a biaxially oriented polyethylene naphthalate substrate (KALEDEX™ 2000) having a thickness of 3.5 mils, and applying thereon with a gravure applicator, a hole blocking layer solution containing 50 grams of 3-amino-propyltriethoxysilane, 41.2 grams of water, 15 grams of acetic acid, 684.8 grams of 200 proof denatured alcohol and 200 grams of heptane. This layer was then dried for about 5 minutes at 135° C. in the forced air dryer of the coater. The resulting blocking layer had a dry thickness of 500 Angstroms.

An adhesive layer was applied over the blocking layer, using a gravure applicator, containing 0.2 percent by weight based on the total weight of the solution of a copolyester adhesive (ARDEL D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was then coated on the above adhesive layer by introducing 0.45 gram of LUPILON 200 (PC-Z 200) available from Mitsubishi Gas Chemical Corporation, and 50 milliliters of tetrahydrofuran into a 4 ounce glass bottle. To this solution were added 2.4 grams of hydroxygallium phthalocyanine Type V and 300 grams of ⅛ inch (3.2 millimeter) diameter stainless steel shot. This mixture was then placed on a ball mill for about 20 to about 24 hours. Subsequently, 1.71 grams of PC-Z 500, 0.672 gram of N,N'-bis-(3,4-dimethylphenyl)-4,4'-biphenyl amine charge transport molecules (HTM) and 0.168 gram of 4-n-butoxycarbonyl-9-fluorenylidene malononitrile electron transporting material (ETM) were dissolved in 22 grams of tetrahydrofuran, and then added to 19.26 grams of the Type V OHGaPc slurry. This slurry was then rolled to mix without milling media overnight, about 18 to 20 hours. The resulting slurry was, thereafter, applied to the adhesive interface with a Bird applicator to form a charge generation layer. The charge generation layer was dried at 120° C. for 20 minutes in a forced air oven to form a dry charge generation layer with a final dry thickness of about 3 microns. This imaging member web was overcoated with a charge transport layer in contact with the charge generation layer. The charge transport layer was prepared by introducing into an amber glass bottle in a weight ratio of 40:10:50 N,N'-bis-(3,4-dimethylphenyl)-4,4'-biphenyl amine charge transport molecules (HTM) and the binder PCZ-500. The resulting mixture was dissolved in tetrahydrofuran to form a solution containing 15 percent by weight solids. This solution was applied on the charge generation layer to form a charge transport layer coating with a final dry thickness of about 17 μm. The imaging member resulting from the application of all the above layers was annealed at 120° C. in a forced air oven for 40 minutes and thereafter cooled to ambient room temperature, about 25° C.

Similar web based photoreceptors were prepared with various weight ratios of pigment:binder:ctm (CTM in following Table) ratios where the pigment is Type V hydroxygallium phthalocyanine, the binder is PCZ500 and the charge transport matrix (CTM) is composed of a 4:1 weight ratio of N,N'-bis-(3,4-dimethylphenyl)-4,4'-biphenyl amine charge transport molecules (HTM) and 4-n-butoxycarbonyl-9-fluorenylidene malononitrile electron transporting material (ETM). The resulting layer thickness, reference the Table that follows, was determined by capacitive measurements and transmission electron spectroscopy.

| Device | Pigment:Binder:CTM (wt %) | As Coated CG Thickness | Ave. CGL Thickness (±0.2 μm) | Ave. CTL Thickness (±0.2 μm) | Ave. Total Thickness (±0.2 μm) |
|---|---|---|---|---|---|
| E | 15/57/28 | 3.23 σ = 0.07 μm | 2.8 μm | 17.0 μm | 19.5 μm |
| F | 20/67/13 | 1.05 μm σ* = 0.03 μm | 1.5 μm | 18.9 μm | 20.7 μm |
| G | 20/57/23 | 1.14 μm σ = 0.07 μm | 2.0 μm | 21.5 μm | 23.6 μm |
| H | 20/47/33 | 1.46 μm σ = 0.8 μm | 1.7 μm | 20.8 μm | 22.6 μm |
| I | 30/57/13 | <1 micron | 1.7 μm | 21.0 μm | 22.8 μm |
| J | 30/47/23 | <1 micron** | 1.6 μm | 20.3 μm | 21.8 μm |
| Comparative Device 3 | 40/60/0 | <1 micron | 1.2 μm | 20.2 μm | 21.0 μm |

*Sigma symbol which represents the standard deviation in the thickness measurement.

**about 0.9 micron.

EXAMPLE IV

The electrical testing processes of Example II were in the photoreceptor devices of Example III, which devices were mounted and grounded to an aluminum drum with silver conductive paste. Note that devices F to J have similar characteristics to the Comparative Device 3 which has a higher pigment:binder ratio. The dark decay and residual voltage were slightly higher for device E indicating that the ratio of the active transport materials (HTM, ETM) and pigment to the binder was of value to, for example, maintain acceptable discharge characteristics including a low residual voltage and low dark decay while maintaining excellent photosensitivity as indicated. The photoinduced discharge characteristics indicate that as the binder ratio was increased (pigment loading remaining constant), sufficient transport occurred within the charge generation layers, while the devices also exhibited excellent charge injection at both the undercoat and transport layer interfaces.

| Device | Pigment:Binder:CTM (wt %) | Photo-sensi-tivity (V $cm^2$/erg) | Residual (V) | Dark Discharge (V/s) |
|---|---|---|---|---|
| E | 15/57/28 | 391 | 50 | 25.5 |
| F | 20/67/13 | 286 | 38 | 15.4 |
| G | 20/57/23 | 327 | 42 | 14.1 |
| H | 20/47/33 | 297 | 33 | 18.2 |
| I | 30/57/13 | 288 | 30 | 17.7 |
| J | 30/47/23 | 287 | 33 | 17.1 |
| Com-parative Device 3 | 40/60/0 | 271 | 33 | 16 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive member comprising a supporting substrate, a hole blocking layer having a thickness of from about 1 to about 20 microns, a photogenerating layer, and a charge transport layer; wherein the photogenerating layer comprises a photogenerating component and an electron transport component, and wherein the electron transport component is selected from the group consisting of a carbonylfluorenone malononitrile of the formula

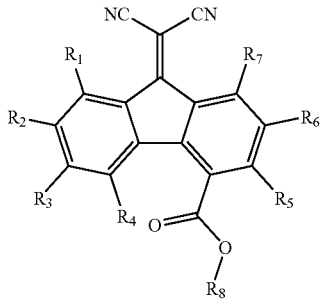

wherein each R is independently selected from the group consisting of hydrogen, alkyl, alkoxy, aryl, and halide; a nitrated fluorenone of the formula

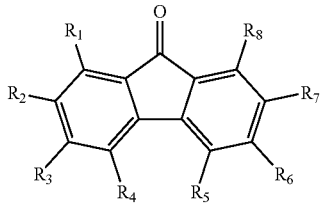

wherein each R is independently selected from the group consisting of alkyl, alkoxy, aryl, and halide, and wherein at least two R groups are nitro; a diimide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

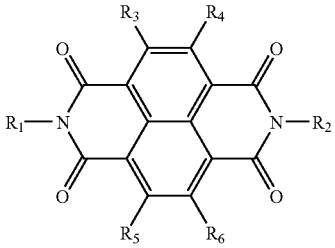

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

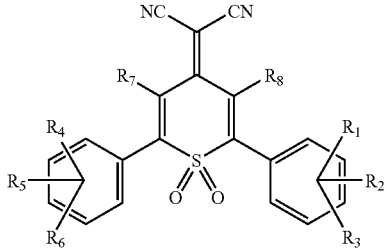

wherein each R is independently selected from the group consisting of hydrogen, alkyl, alkoxy, aryl, and halide; a carboxybenzylnaphthaquinone of the alternative formulas

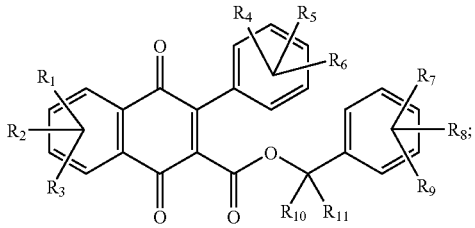

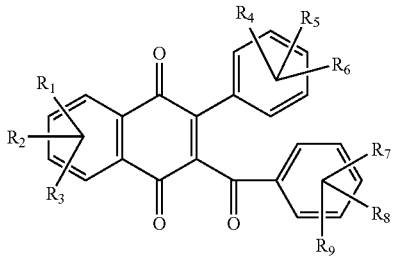

wherein each R is independently selected from the group consisting of hydrogen, alkyl, alkoxy, aryl, and halide; and a diphenoquinone of the formula

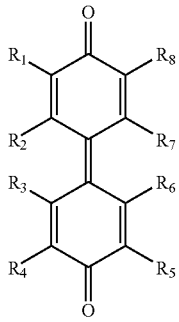

wherein each R is independently selected from the group consisting of hydrogen, alkyl, alkoxy, aryl, and halide.

2. A member in accordance with claim 1 wherein said member is of a thickness of from about 5 to about 100 microns.

3. A member in accordance with claim 1 wherein the amount for each of said components in said photogenerating layer is from about 0.05 weight percent to about 60 weight percent for the photogenerating component; and from about 1 weight percent to about 75 weight percent for the electron transport component; and wherein the total of said components is about 100 percent; and wherein said layer components are dispersed in from about 10 weight percent to about 75 weight percent of a polymer binder; and optionally wherein said photogenerating layer is of a thickness of from about 0.1 to about 50 microns.

4. A member in accordance with claim 1 wherein the amount for each of said components in the photogenerating layer mixture is from about 0.5 weight percent to about 60 weight percent for the photogenerating component, and from about 1 weight percent to about 70 weight percent for the electron transport component; and which components are contained in from about 10 weight percent to about 70 weight percent of a polymer binder.

5. A member in accordance with claim 1 wherein said charge transport is comprised of hole transport molecules; said substrate is comprised of a drum or a belt; said photogenerating layer contains a hydroxygallium phthalocyanine or a chlorogallium phthalocyanine; said electron transport is BCFM or 2-EHCFM; and optionally wherein said photogenerating layer and said charge transport layer contain a polycarbonate binder.

6. A member in accordance with claim 1 wherein there is selected a binder for said photogenerating layer, and which binder is selected from the group consisting of polyesters, polyvinyl butyrals, polycarbonates, polystyrene-b-polyvinyl pyridines, and polyvinyl formulas.

7. A member in accordance with claim 1 wherein said photogenerating layer absorbs light of a wavelength of from about 370 to about 950 nanometers.

8. A member in accordance with claim 1 wherein the supporting substrate is comprised of a conductive substrate comprised of a metal.

9. A member in accordance with claim 8 wherein the conductive substrate is aluminum, aluminized polyethylene terephthalate or titanized polyethylene terephthalate.

10. A member in accordance with claim 1 wherein said charge transport layer comprises aryl amine molecules.

11. A member in accordance with claim 1 wherein said charge transport layer comprises

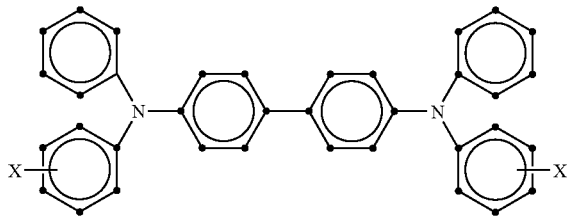

wherein X is selected from the group consisting of alkyl and halogen.

12. A member in accordance with claim 11 wherein alkyl contains from about 1 to about 10 carbon atoms.

13. A member in accordance with claim 11 wherein alkyl contains from 1 to about 5 carbon atoms.

14. A member in accordance with claim 11 wherein alkyl is methyl, and wherein halogen is chloride.

15. A member in accordance with claim 11 wherein said charge transport is N,N'-diphenyl-N,N-bis(3-methyl phenyl)-1,1'-biphenyl-4,4'-diamine.

16. A member in accordance with claim 1 wherein said electron transport component is comprised of said carbonylfluorenone malononitrile of the formula

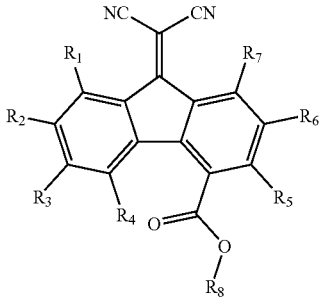

wherein each R is independently selected from the group consisting of hydrogen, alkyl with from 1 to about 40 carbon atoms, alkoxy with from 1 to about 40 carbon atoms, phenyl, substituted phenyl, naphthalene, anthracene, alkylphenyl with from 6 to about 40 carbon atoms, alkoxyphenyl with from 6 to about 40 carbon atoms, aryl with from 6 to about 30 carbon atoms, substituted aryl with from 6 to about 30 carbon atoms, and halogen; said nitrated fluorenone of the formula

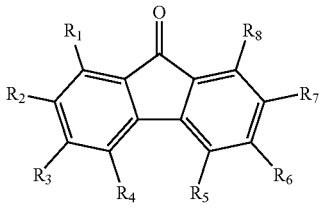

wherein each R is independently selected from the group consisting of hydrogen, alkyl with from 1 to about 40 carbon atoms, alkoxy with from 1 to about 40 carbon atoms, phenyl, substituted phenyl, naphthalene, anthracene, alkylphenyl with from 6 to about 40 carbon atoms, alkoxyphenyl with from 6 to about 40 carbons, aryl with from 6 to about 30 carbons, substituted aryl with from 6 to about 30 carbon atoms and halogen, and wherein two of said R groups are nitro; said diimide represented by said formula

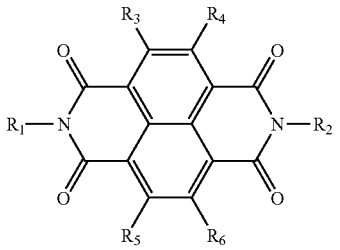

wherein $R_1$ is alkyl, cycloalkyl, alkoxy, or aryl of phenyl, naphthyl, or anthryl; $R_2$ is alkyl, branched alkyl, cycloalkyl, or aryl of phenyl, naphthyl, or anthryl, and $R_2$ contains from about 1 to about 50 carbon atoms; $R_3$, $R_4$, $R_5$ and $R_6$ are alkyl, branched alkyl, cycloalkyl, alkoxy, or aryl of phenyl, naphthyl, or anthryl and halogen; $R_3$, $R_4$, $R_5$ and $R_6$ can be similar or dissimilar; and wherein $R_3$, $R_4$, $R_5$ and $R_6$ contain from 1 to about 25 carbon atoms; said 1,1'-dioxo-2-(aryl)-6-phenyl-4-(dicyanomethylidene) thiopyran is of the formula

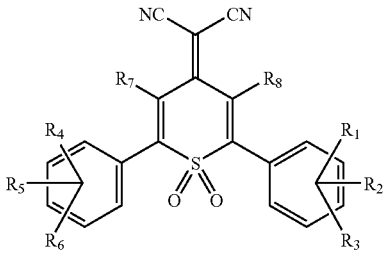

wherein each R is independently selected from the group consisting of hydrogen, alkyl with from 1 to about 40 carbon atoms, alkoxy with from 1 to about 40 carbon atoms, phenyl, naphthalene and anthracene, alkylphenyl with from about 6 to about 40 carbon atoms, alkoxyphenyl with from about 6 to about 40 carbons, aryl with from about 6 to about 30 carbons, and halogen; said carboxybenzylnaphthaquinone of the formula

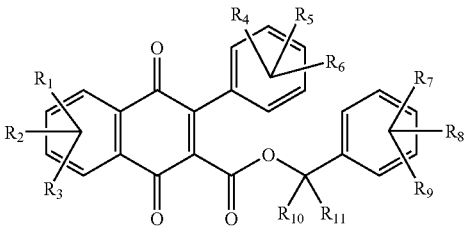

and/or

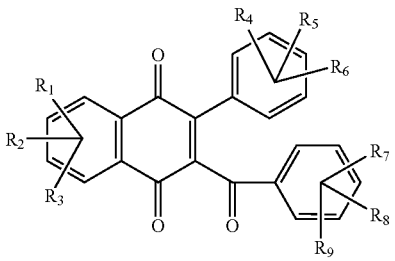

wherein each R is independently selected from the group consisting of hydrogen, alkyl with from 1 to about 40 carbon atoms, alkoxy with from 1 to about 40 carbon atoms, phenyl, naphthyl and anthryl, alkylphenyl with from about 6 to about 40 carbon atoms, alkoxyphenyl with from about 6 to about 40 carbon atoms, or optionally wherein R is aryl with from about 6 to about 30 carbon atoms, substituted aryl with from about 6 to about 30 carbon atoms and halogen; and said diphenoquinone of the formula

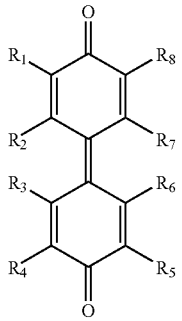

wherein each R is independently selected from the group consisting of hydrogen, alkyl with from about 1 to about 40 carbon atoms, alkoxy with from about 1 to about 40 carbon atoms, alkylphenyl with from about 6 to about 40 carbon atoms, alkoxyphenyl with from about 6 to about 40 carbon atoms, and halogen.

17. A member in accordance with claim 1 wherein said electron transport component is (4-n-butoxycarbonyl-9-fluorenylidene) malononitrile.

18. A member in accordance with claim 1 wherein said electron transport is (4-n-butoxy carbonyl-9-fluorenylidene) malononitrile, and said charge transport is a hole transport of N,N'-diphenyl-N,N-bis(3-methyl phenyl)-1,1'-biphenyl-4,4"-diamine molecules.

19. A member in accordance with claim 1 wherein said photogenerating component is hydroxygallium phthalocyanine.

20. A member in accordance with claim 1 wherein said photogenerating component is a chlorogallium phthalocyanine, or a hydroxygallium phthalocyanine.

21. A member in accordance with claim 1 wherein for said photogenerating layer and said charge transport layer there is included a binder of a polycarbonate optionally with a weight average molecular weight of from about 500 to about 80,000.

22. A member in accordance with claim 1 further containing an adhesive layer coated on said blocking layer.

23. A member in accordance with claim 1 wherein said charge transport contains a binder of a polycarbonate, or polystyrene-b-polyvinyl pyridine.

24. A photoconductive member in accordance with claim 1 wherein said electron transport component is a carbonylfluorenone malononitrile of the formula

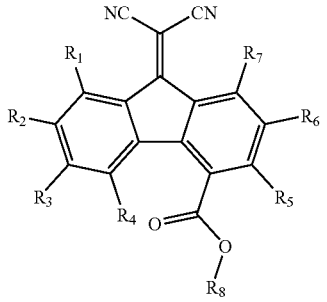

wherein each R is independently selected from the group consisting of alkoxy, hydroQen, aryl, halide and alkyl.

25. A member in accordance with claim 1 wherein said photogenerating layer contains a mixture of pigments.

26. A member in accordance with claim 1 wherein said photogenerating layer contains a mixture of two pigments, a first and second pigment, and wherein said first pigment possesses a higher photosensitivity than said second pigment, and said second pigment possesses a lower photosensitivity than said first pigment, and wherein said first pigment is present in an amount of from about 1 to about 99 weight percent, and said second pigment is present in an amount of from about 99 to about 1 weight percent.

27. A member in accordance with claim 26 wherein said second pigment is a hydroxygallium phthalocyanine.

28. A photoconductive member comprised of a supporting substrate, a hole blocking layer having a thickness of from about 1 to about 20 microns, a photogenerating layer, and a hole transport layer; wherein the photogenerating layer comprises a photogenerating component and an electron transport component; and wherein the electron transport component is selected from the group consisting of a carbonylfluorenone malononitrile of the formula

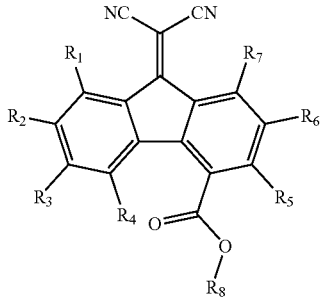

wherein each R is independently selected from the group consisting of hydrogen, alkyl, alkoxy, aryl, and halide; a nitrated fluorenone of the formula

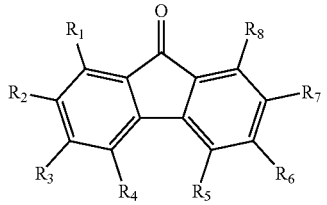

wherein each R is independently selected from the group consisting of alkyl, alkoxy, aryl, and halide, and wherein at least two R groups are nitro; a diimide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

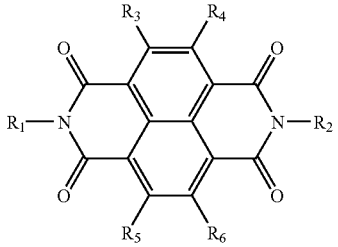

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

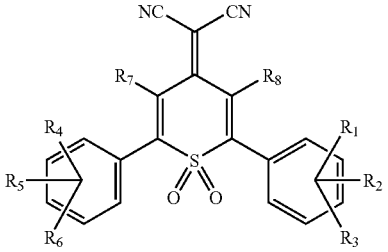

wherein each R is independently selected from the group consisting of hydrogen, alkyl, alkoxy, aryl, and halide; a carboxybenzylnaphthaquinone of the alternative formulas

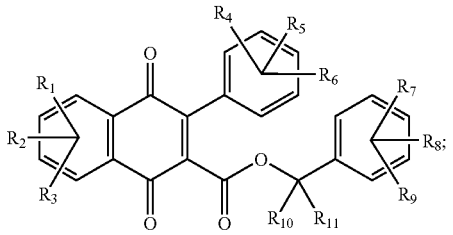

-continued
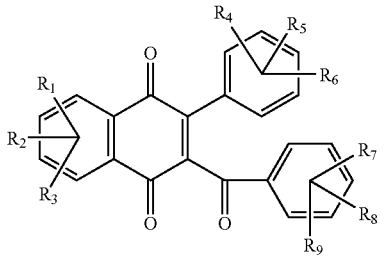
wherein each R is independently selected from the group consisting of hydrogen, alkyl, alkoxy, aryl, and halide; and a diphenoquinone of the formula
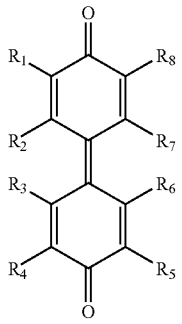
wherein each R is independently selected from the group consisting of hydrogen, alkyl, alkoxy, aryl, and halide.
* * * * *